US007388324B2

(12) United States Patent
Foo

(10) Patent No.: US 7,388,324 B2
(45) Date of Patent: Jun. 17, 2008

(54) ALL-ROUNDED ILLUMINATION ENVELOPED FLUORESCENT LAMP

(75) Inventor: Onn Fah Foo, Kowloon (HK)

(73) Assignee: Mass Technology (H.K.) Limited, Kowloon, Hong Kong (CN)

( * ) Notice: Subject to any disclaimer, the term of this patent is extended or adjusted under 35 U.S.C. 154(b) by 564 days.

(21) Appl. No.: 11/081,039

(22) Filed: Mar. 15, 2005

(65) Prior Publication Data

US 2005/0200285 A1 Sep. 15, 2005

(30) Foreign Application Priority Data

Mar. 15, 2004 (CN) ..... 2004 2 0008389 U
Nov. 8, 2004 (CN) ..... 2004 1 0092769

(51) Int. Cl.
*H01J 17/16* (2006.01)
*H01J 61/30* (2006.01)

(52) U.S. Cl. ..... 313/493; 313/634; 315/56; 362/216

(58) Field of Classification Search ..... None
See application file for complete search history.

(56) References Cited

U.S. PATENT DOCUMENTS 6,492,773 B2 * 12/2002 Gyoten et al. ..... 315/56
6,781,315 B2 * 8/2004 Nishio et al. ..... 315/56
7,053,554 B2 * 5/2006 Yasuda et al. ..... 313/634
2002/0167264 A1 * 11/2002 Nishio et al. ..... 313/493

* cited by examiner

*Primary Examiner*—Ashok Patel
(74) *Attorney, Agent, or Firm*—Alix, Yale & Ristas, LLP

(57) ABSTRACT

An all-rounded illumination enveloped fluorescent lamp. The light translucent materials used for lamp carrier disk fixing lamp tube, segregation board segregating wires, ballast circuit board and rear housing enables light emitted by the lamp tube to penetrate through the rear housing, thus causing the whole lamp body to illuminate as the lamp is turned on. The rear housing, which is made of PC plastic with proper amount of colour powder added, provides good light transmission property but is not transparent, thus shielding the ballast. No darkness zone is formed when in use. The lamp thus provides an advantageous aesthetic quality and illumination effect. The light transmission amount of the rear housing is increased further by setting the circuit board perpendicular to the lamp carrier disk or by adjusting the circuit board to be smaller than the bottom projection of lamp tube.

17 Claims, 4 Drawing Sheets

ALL-ROUNDED ILLUMINATION ENVELOPED FLUORESCENT LAMP

FIELD OF THE INVENTION

This present invention relates to an illuminative fluorescent lamp and, in particular, to a compact fluorescent lamp capable of all-rounded illumination throughout the whole lamp body.

BACKGROUND OF THE INVENTION

Existing enveloped fluorescent lamps in the current market are commonly made up of a lamp envelope, lamp tube, lamp carrier disk, ballast on circuit board, rear housing and lamp base. With this type of fluorescent lamp, the lamp tube is fixed on the proximate end of the lamp carrier disk; the ballast circuit board is set on the distal end of the lamp carrier disk; the ballast connects to the lamp tube and lamp base; the lamp carrier disk and circuit board are fixed and encapsulated in the space connecting the lamp envelope and rear housing, such that the lamp envelope contains the lamp tube and the rear housing contains the ballast; and the lamp base is fixed firmly on the tail portion of the rear housing. As a result, only a lamp envelope made of transparent or translucent materials can let light emitted by the lamp tube to penetrate through the lamp envelope on the proximate end of lamp body. The rear housing is made of non-translucent plastic materials in order to shield the inner ballast and to give a beautiful appearance of the lamp. Hence, with the darkness zone formed by covering with a plastic rear housing at the distal end of enveloped fluorescent lamp, the aesthetic appearance is lost, while light output for illumination also suffers. Additionally, the enveloped fluorescent lamps in the current market always come in bulky dimension and it is difficult to use in the application areas where a small dimension is required.

SUMMARY OF THE INVENTION

The first object of the present invention is to provide an enveloped fluorescent lamp capable of all-rounded illumination, of light emitted by the lamp tube, throughout the whole lamp body, except the lamp base.

The second object of the present invention is to provide an enveloped compact fluorescent lamp with small dimension, yet capable of all-rounded illumination throughout the whole lamp body, except the lamp base.

In order to achieve the foregoing objects, the all-rounded illumination enveloped fluorescent lamp includes a lamp envelope made with light translucent materials, lamp tube, lamp carrier disk, ballast set on the circuit board, rear housing and lamp base. In this fluorescent lamp, the lamp tube is fixed on the proximate end of the lamp carrier disk; the ballast circuit board is set on the distal end of the lamp carrier disk; the ballast is connected to the lamp tube and lamp base; the lamp carrier disk and circuit board are fixed and encapsulated in the space connecting the lamp envelope and the rear housing, such that the lamp envelope contains the lamp tube and the rear housing contains the ballast; and the lamp base is fixed firmly on the tail portion of the rear housing. The light translucent materials used for the lamp carrier disk, circuit board and rear housing described previously enable light irradiating to the rear part of the fluorescent lamp from lamp tube to penetrate through the rear housing via the lamp carrier disk and circuit board; or, the circuit board can be set perpendicularly to the lamp carrier disk to enable light irradiating to the rear part of the fluorescent lamp from the lamp tube to penetrate through the rear housing via the lamp carrier disk even if the circuit board has no light transmission. Consequently, the rear housing and the lamp envelope together form an illumination body with light transmission.

Preferably, the lamp carrier disk described previously is made of transparent PC plastic; the circuit board is made of transparent fiberboard; and the rear housing is made of transparent PC plastic with added colour powder.

Furthermore, the lamp carrier disk is parallel with the circuit board and projection of the circuit board on the axial line of the whole lamp is smaller than that of the lamp tube.

As segregation board is required, the board made of light translucent materials may be set in parallel between the circuit board and lamp carrier disk, and the projection of the segregation board on the axial line of the whole lamp is smaller than that of the lamp tube.

In order to achieve the second object, feasible techniques based on the schemes described previously may be accomplished as follows: the axial line of the lamp tube described previously superposes with that of the whole lamp and the tail of the lamp tube is conglutinated on the proximate end of the lamp carrier disk; the ballast is made by surface mount procedure with small dimension components and surface mount components and thus some of its components are mounted into the inner space of the lamp base.

Another feasible scheme is disclosed as follows: the axial line of the lamp tube is perpendicular to that of the whole lamp, and its waist is fixed on the proximate end of the lamp carrier disk with metal clips; the ballast is made by a surface mount procedure with small dimension components and surface mount components and thus some of its components are mounted into the inner space of the lamp base.

The all-rounded illumination enveloped fluorescent lamp of the present invention abandons an old expression which exist in this field for a long time, namely "to harmonize the appearance and aesthetic quality, the inner ballast must be covered and rear housing must be made with materials having no light transmission and without considering light loss from the distal end of lamp body". In the present invention, the light translucent materials used for the lamp carrier disk fixing lamp tube, the segregation board segregating wires, the circuit board of ballast and the rear housing enable light emitted by the lamp tube to penetrate through the rear housing via the lamp carrier disk, segregation board and circuit board. As a result, the whole lamp body is illuminant when the lamp is turned on. Thus more light emitted by the lamp tube penetrates through and increases the illumination effect. The rear housing is made of PC plastic with an added proper amount of colour powder to enhance the good light transmission property but not to the extent of being transparent, thus it still covers the inner ballast so that the beautiful appearance of the lamp is maintained before power is turned on and makes the inner ballast not to be so conspicuous when power is turned on. For example, with added white colour powder, the rear housing appears in white; irradiated light becomes more beautiful with its softness and harmony with the colour of the lamp envelope. Using the present invention, an all-rounded illumination enveloped fluorescent lamp can eliminate the inevitable darkness zone which is common among the existing enveloped fluorescent lamps, and still displays aesthetic quality and illumination effect of the lamp adequately. In terms of the structure, initially the ballast circuit board is installed perpendicularly on the distal end of the lamp carrier disk or in parallel setting with the lamp carrier disk and circuit board with projection of circuit board on the axial line of the whole lamp being smaller than that of the lamp tube, the amount of light penetration through the rear housing is increased further. By applying the compact lamp tube with structure of SLU or SL or 3U improved type or 4SL having its tail conglutinated on the lamp carrier disk or the compact lamp tube with structure of 2SL fixed on the lamp carrier disk with metal clips, and by combining ballast made by surface mount procedure with small dimension components and surface mount components to allow the internal space to be used fully and by mounting some of the components into the inner space of lamp base, the length and diameter of whole lamp can be reduced efficiently.

The various objects and advantages of the present invention will be more readily understood from the following detailed description when read in conjunction with the appended drawings.

DETAILED DESCRIPTION OF THE PREFERRED EMBODIMENT

APPLICATION EXAMPLE 1

Figure 1:
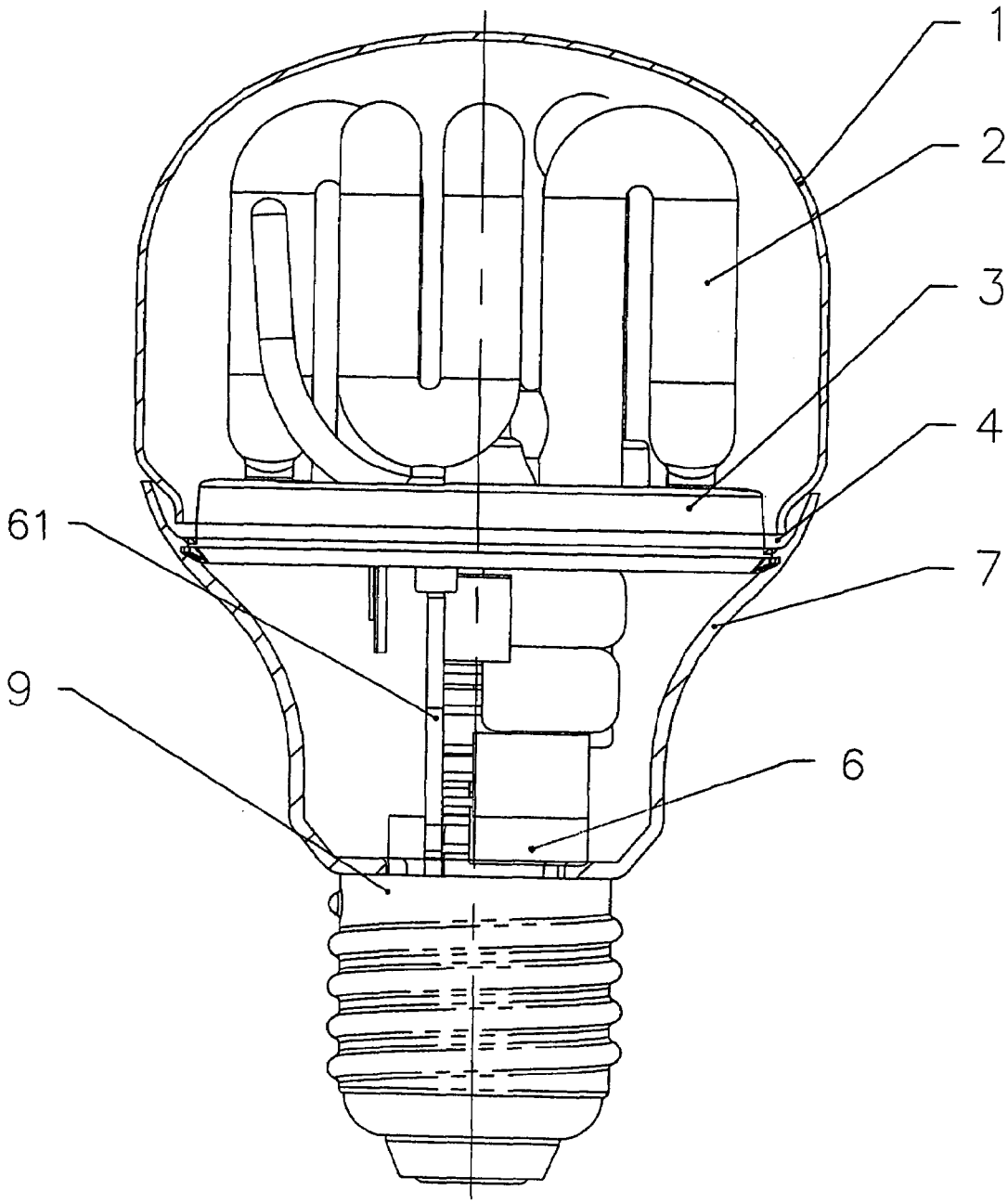
FIG. 1 is an axial cross-sectional view of Example 1 of the present invention.

Referring to FIG. 1, a T60-type lamp envelope made of diffusive transparent plastic materials is used for lamp envelope 1. Lamp tube 2 is a 4SL-type compact lamp tube, and matches with lamp envelope 1, with its tail conglutinated firmly on the proximate end of lamp carrier disk 3 made by transparent PC plastic and its axial line superposing with the axial line of the whole lamp. Circuit board 61, made by opaque fiberboard, of ballast 6 is fixed perpendicularly on the distal end of the lamp carrier disk 3. The ballast 6, made by surface mount procedure with small dimension components and surface mount components, connects to the lamp tube 2 and lamp base 9, with circuit board 61 and some of its components mounted into the inner space of lamp base 9.

The trumpet-shape rear housing 7 having slot 71 at the front portion of its opening and E27 standard-type lamp base 9 installed firmly on its tail portion is made of transparent PC plastic with added ivory-white colour powder. The convex edge of lamp carrier disk 3 is locked on the slot 71 of rear housing 7; lamp carrier disk 3 and circuit board 61 installed on its distal end are fixed thereon fittingly. The opening on proximate end of rear housing 7 contains the opening of distal end of lamp envelope 1. All of these connection areas are agglutinated together with glue 4 for sealing. The lamp carrier disk 3 and circuit board 61 are fixed and encapsulated in the space connecting with lamp envelope 1 and rear housing 7 thus lamp envelope 1 contains lamp tube 2 and rear housing 7 contains ballast 6. The rear housing 7 in this example is usually ivory-white and harmonizing with the colour of lamp envelope 1, thus enabling lamp tube 2 and ballast 6 not to be seen.

With power on, although circuit board 61 has no light transmission, enough space making light through between the ballast on the distal end of lamp carrier disk 3 and rear housing 7 allows light irradiating to the rear part of the fluorescent lamp from the lamp tube to penetrate through rear housing 7 via the lamp carrier disk 3 due to the circuit board 61 being oriented perpendicularly to the lamp carrier disk 3. Hence, an illuminant body with light transmission is formed with rear housing 7 and lamp envelope 1 and viewers cannot see ballast 6.

APPLICATION EXAMPLE 2

Figure 2:
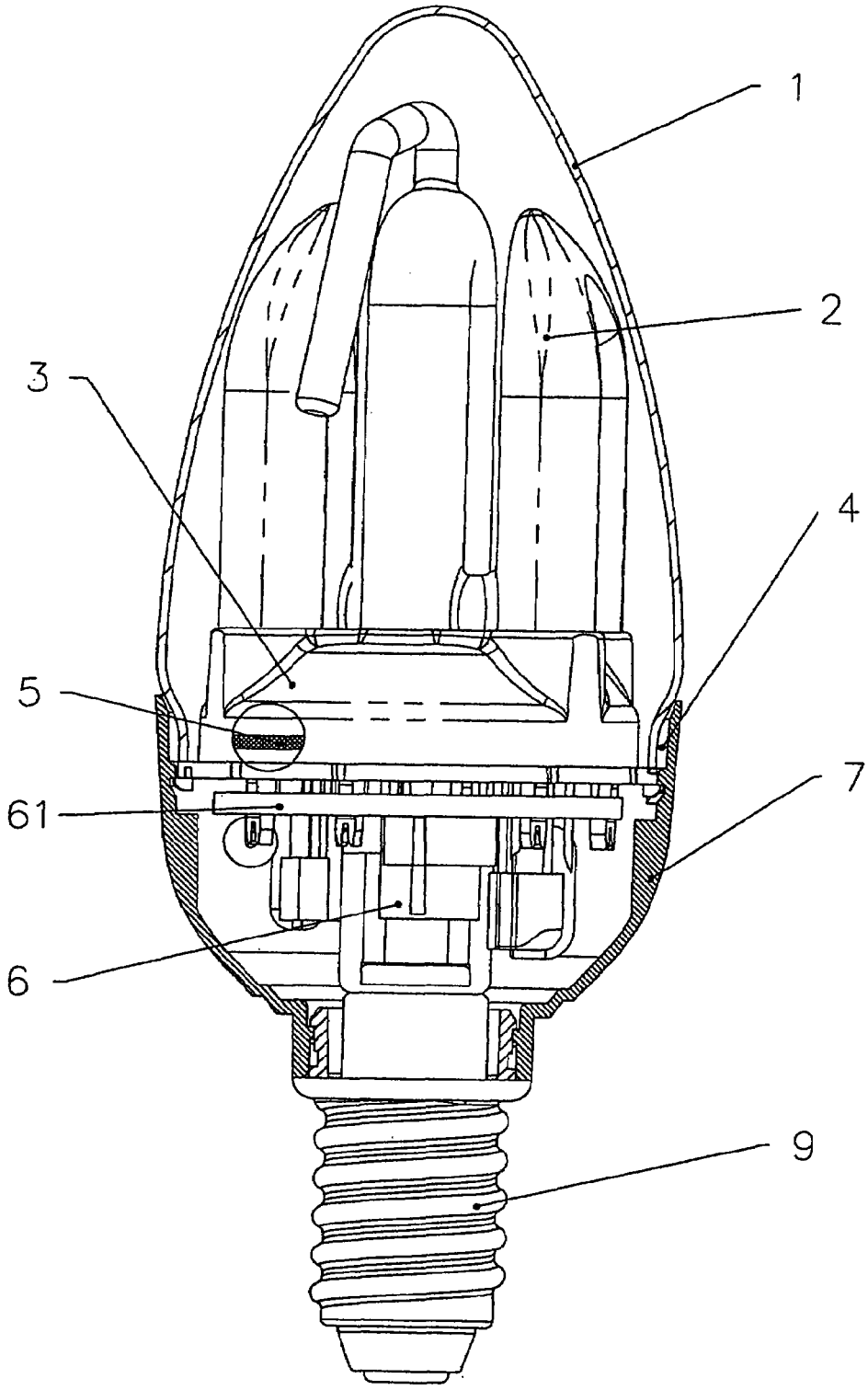
FIG. 2 is an axial cross-sectional view of Example 2 of the present invention.

Referring to FIG. 2, spire-shape lamp bulb made of diffusive transparent plastic materials is used for lamp envelope 1. Lamp tube 2 is a 3U improved-type or compact lamp tube and matches with lamp envelope 1, with its tail conglutinated and fixed on the proximate end of lamp carrier disk 3 made by transparent PC plastic and its axial line superposing with the axial line of the whole lamp. Segregation board 5 with segregating property made of transparent PC plastic is installed parallely at the inner space of lamp carrier disk 3, and circuit board 61 of ballast 6 is installed parallely at the distal end of lamp carrier disk 3. Circuit board 61 is made by transparent fiberboard, and the projection of it on the axial line of the whole lamp is smaller than that of lamp tube 2 and much smaller than that of lamp carrier disk 3. The ballast 6 is made by surface mount procedure with small dimension components and surface mount components connects lamp tube 2 and lamp base 9, with some of its components mounted into the inner space of lamp base 9.

The trumpet-shape rear housing 7, having relatively longer tail and made of transparent PC plastic with added colour powder, is fixed on the lamp base 9 made of E14 standard-type, and its opening on the proximate end has slot 71. The convex edge of lamp carrier disk 3 locked in the slot 71 of rear housing 7 makes the lamp carrier disk 3, segregation board 5 and circuit board 61 installed on the distal end of lamp carrier disk 3 to be fixed on this position fittingly. The opening on proximate end of rear housing 7 contains the opening on the tail of lamp envelope 1. All of these connections are agglutinated together with glue 4 for sealing. The lamp carrier disk 3, segregation board 5 and circuit board 61 are fixed and encapsulated in the space connecting to lamp envelope 1 and rear housing 7. Thus lamp envelope 1 contains lamp tube 2 and rear housing 7 contains ballast 6. With the projection of circuit board 61 on the axial line of the whole lamp being smaller than those of lamp tube 2 and lamp carrier disk 3, part of the light emitted rearward by lamp tube 2 irradiates to the rear housing 7 through lamp carrier disk 3, segregation board 5, circuit board 61 and the space among the components on the circuit board 61. Part of this light irradiates to the rear housing 7 through lamp carrier disk 3 other than circuit board 61. Thus more light penetrates through rear housing 7 when the power is turned on.

APPLICATION EXAMPLE 3

Figure 3:
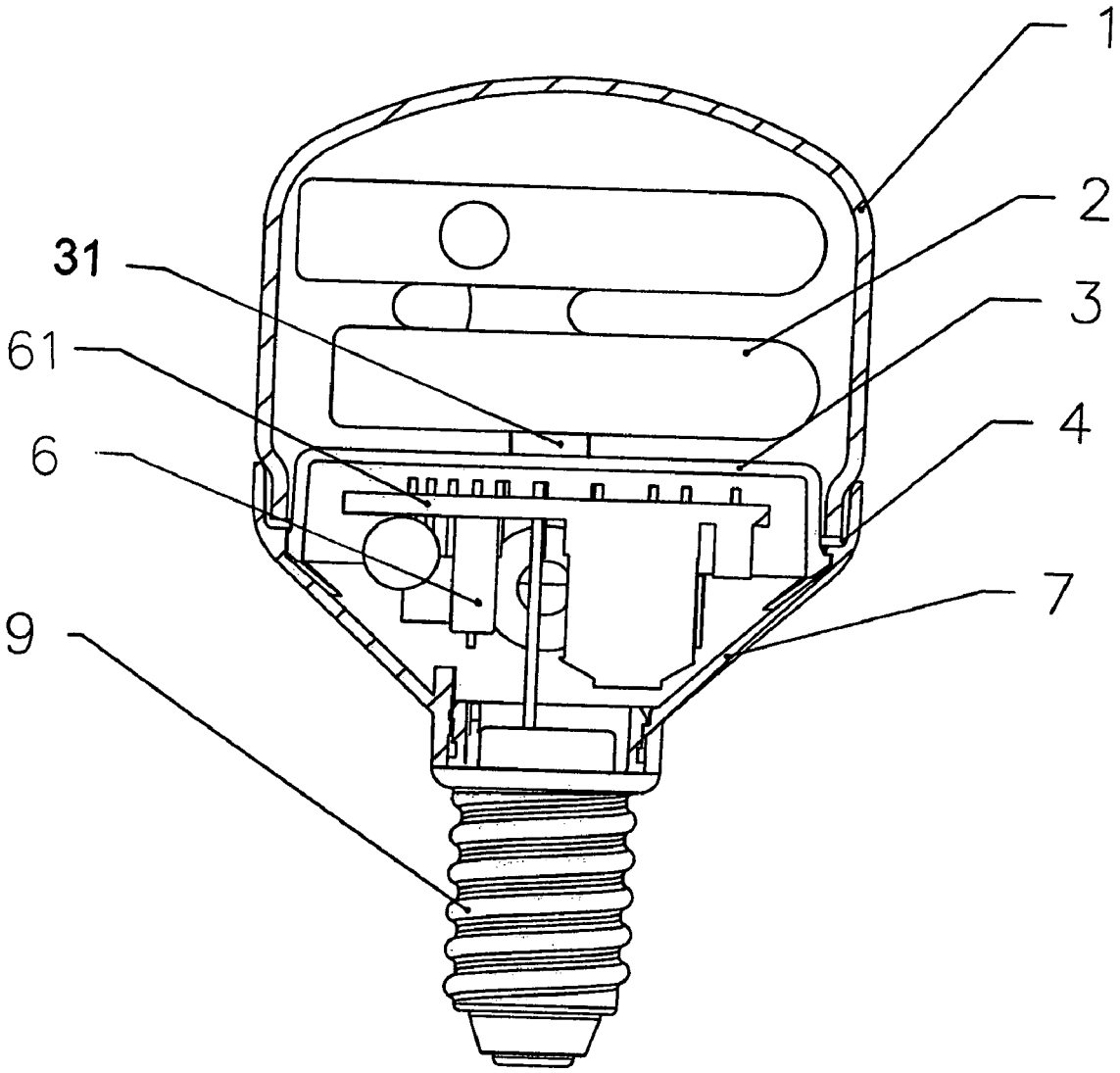
FIG. 3 is an axial cross-sectional view of Example 3 of the present invention.

Referring to FIG. 3, a T45-type lamp envelope made of diffusive transparent glass materials is used for lamp envelope 1. Lamp tube 2 is a 2SL-type compact lamp tube and matches with lamp envelope 1. Lamp tube 2 is fixed on the proximate end of lamp carrier disk 3 made by transparent PC plastic with a metal clip and the axial line of the lamp tube is perpendicular to the axial line of the whole lamp. Circuit board 61, made by transparent fiberboard, of ballast 6 is fixed parallely on the distal end of lamp carrier disk 3. The projection of circuit board on the axial line of the whole lamp is smaller than that of lamp tube 2 and much smaller than that of lamp carrier disk 3. The ballast 6 made by surface mount procedure with small dimension components and surface mount components connects to lamp tube 2 and lamp base 9, with some of its components mounted into the inner space of lamp base 9.

The trumpet-shape rear housing 7, having relatively longer tail and made of transparent PC plastic with added colour powder, is fixed on the lamp base 9 made of E14 standard-type, and its opening on the proximate end has slot 71. The convex edge of lamp carrier disk 3 locked in the slot 71 of rear housing 7 makes the lamp carrier disk 3 and circuit board 61 installed on the distal end of lamp carrier disk 3 to be fixed on this position fittingly. The opening on proximate end of rear housing 7 contains the opening on the tail portion of lamp envelope 1. All of these connections are agglutinated together with glue 4 for sealing. The lamp carrier disk 3 and circuit board 61 are fixed and encapsulated in the space connecting to lamp envelope 1 and rear housing 7. Thus lamp envelope 1 contains lamp tube 2 and rear housing 7 contains ballast 6. This example illustrates the same principle of light penetrating through rear housing 7 as the last one; however, the axial line of lamp tube 2 being perpendicular to that of the whole lamp allows more and stronger light to irradiate to and penetrate through rear housing 7.

Compared with Example 1, the shorter space containing circuit board 61 on the proximate end of rear housing 7 makes the length of whole lamp shorter. Yet, the style of parallel fixing lamp tube 2 on the proximate end of lamp carrier disk 3 with the metal clip can also be employed in Example 1.

APPLICATION EXAMPLE 4

Figure 4:
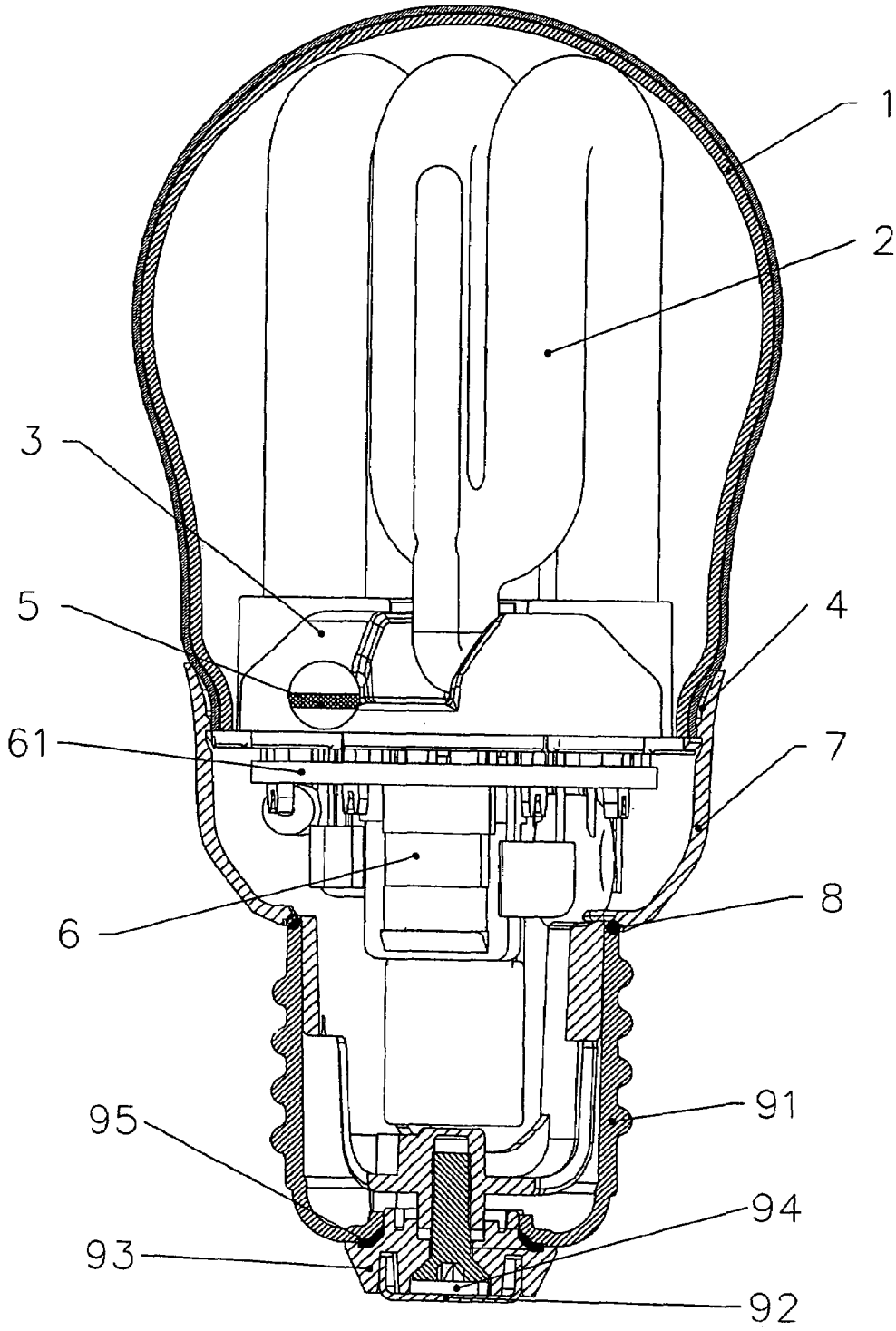
FIG. 4 is an axial cross-sectional view of Example 4 of the present invention.

Referring to FIG. 4, an orbicular lamp bulb with multiplex structure made of diffusive transparent plastic materials is used for lamp envelope 1. Lamp tube 2 is a SLU-structure compact lamp tube and matches with lamp envelope 1, with its tail conglutinated and fixed on the proximate end of lamp carrier disk 3 made by transparent PC plastic and its axial line superposing with the axial line of the whole lamp. Segregation board 5 made of transparent PC plastic is installed at inner space of lamp carrier disk 3, and ballast 6 is installed at the distal end of lamp carrier disk 3. Circuit board 61 of ballast being parallel with lamp carrier disk 3, is made by transparent fiberboard, and the projection of it on the axial line of whole lamp is smaller than that of lamp tube 2 and much smaller than that of lamp carrier disk 3. Segregation board 5 being parallely set between circuit board 61 and lamp carrier disk 3 can segregate wires of lamp tube 2 and circuit board 61. The ballast 6 made by a surface mount procedure with small dimension components and surface mount components connects to lamp tube 2 and lamp base 9, with some of its components mounted into the inner space of lamp base 9.

The trumpet-shape rear housing 7 is made of transparent PC plastic with added colour powder, and its tail is fixed on the lamp base 9 made of E27 standard-type. The lamp base 9 in this example includes metal thread shell 91, metal touching piece 92, insulation piece 93 between metal thread shell 91 and metal touching piece 92, tight bolt 94 sheathed in the insulation piece 93 and connecting the end portion of rear housing 7 and sealed loop 95 between thread shell 91 and insulation piece 93. A rubber loop 8 is set at the connection point between the tail portion of rear housing 7 and the opening on proximate end of thread shell 91 of lamp base 9. Slot 71 is set at the opening on the proximate end of rear housing 7. The convex edge of lamp carrier disk 3 locked in the slot 71 of rear housing 7 makes the lamp carrier disk 3, segregation board 5 and circuit board 61 installed on the distal end of lamp carrier disk 3 to be fixed on this position fittingly. The opening on the proximate end of rear housing 7 contains the opening on the tail portion of lamp envelope 1. All of these connections are agglutinated together with glue 4 for sealing. The lamp carrier disk 3, segregation board 5 and circuit board 61 are fixed and encapsulated in the space connecting with lamp envelope 1 and rear housing 7. Thus lamp envelope 1 contains lamp tube 2 and rear housing 7 contains ballast 6. In this example, with the projections of circuit board 61 and segregation board 5 on the axial line of the whole lamp being smaller than those of lamp tube 2 and lamp carrier disk 3, part of light emitted backward by lamp tube 2 irradiates to the rear housing 7 through lamp carrier disk 3, segregation board 5, circuit board 61 and the space among the components on the circuit board 61, and part of this light irradiates to the rear housing 7 through lamp carrier disk 3 other than circuit board 61. Thus more light penetrates through rear housing 7 after the power is turned on. Compact style lamp tube with SL structure may be used in this example.

Based on the design of all-rounded illumination enveloped fluorescent lamp in this present invention, the invention scope extends, firstly, to all light translucent materials used for lamp carrier disk fixing lamp tube, segregation board segregating wires, circuit board of ballast and rear housing makes light emitted by lamp tube to penetrate through the rear housing via the lamp carrier disk, segregation board and circuit board, which, consequently, illuminates the whole lamp body as the lamp is turned on. It extends particularly to those rear housings made of PC plastic with added proper amount of colour powder with good light transmission property but not transparent. The invention scope extends, secondly, to installing circuit board of ballast perpendicularly at the distal end of lamp carrier disk or lamp carrier disk being parallel with circuit board as well as the projection of circuit board on the axial line of the whole lamp being smaller than that of the lamp tube increases light transmission amount of the rear housing. Thirdly, the invention scope extends to using the lamp tube with structure of SLU or SL or 3U improved-type or 4SL or 2SL. Ballast made by surface mount procedure with small dimension components and surface mount components allow the limited internal space to be used fully and make the whole lamp more compact by mounting some of the components into the inner space of the lamp base.

E27 and E14 standard lamp base used in the examples disclosed herein are not intended to be restrictive. Based on the market requirements, the tail structure of the rear housing may be modified partially depending on the lamp base used.

It is to be understood that the embodiments described in the patent specification herein are not intended to be, nor should it be deemed to be, limited thereby and such other modifications or embodiments without departing from the spirit and essential characteristics of such invention herein are particularly reserved especially as they fall within the breadth and scope of the claims here appended.

What is claimed is:

1. An all-rounded illumination enveloped fluorescent lamp, comprising a lamp envelope made of light translucent materials, a lamp base, a lamp tube having a tail, a circuit board, a lamp carrier disk having a distal end that faces the lamp base and proximate end that faces the lamp tube, a ballast on the circuit board, a rear housing having a tail and a top end, wherein said lamp tube is fixed on the proximate end of said lamp carrier disk and said ballast on the circuit board is installed on the distal end of said lamp carrier disk; said ballast connects said lamp tube and said lamp base; said lamp envelope is connected to the top end of the rear housing; the lamp carrier disk and said circuit board are fixed and encapsulated in the space defined by the interior of the connected lamp envelope and rear housing such that said lamp envelope contains said lamp tube and said rear housing contains said ballast; and said lamp base is firmly installed on the tail of said rear housing and said lamp carrier disk and said circuit board and rear housing are made of light translucent materials.

2. The all-rounded illumination enveloped fluorescent lamp of claim 1, wherein said lamp carrier disk is made of transparent PC plastic, said circuit board is made of transparent fiberboard, and said rear housing is made of transparent PC plastic with added colour powder.

3. The all-rounded illumination enveloped fluorescent lamp of claim 1, wherein said lamp has an axial length and said circuit board has a thickness, said circuit board is parallel with said lamp carrier disk and the thickness of said circuit board along the axial length of the lamp is smaller than that of said lamp tube.

4. The all-rounded illumination enveloped fluorescent lamp of claim 1, wherein said lamp has an axial length, a segregation board with a thickness made with light translucent materials is installed in parallel between the circuit board and lamp carrier disk, and the thickness of said segregation board along the axial length of said lamp is smaller than that of said lamp tube.

5. The all-rounded illumination enveloped fluorescent lamp of claim 1, wherein said lamp and lamp tube each have an axial length, the axial length of said lamp tube superposes with that of the lamp and the tail of said lamp tube is conglutinated on the proximate end of the lamp carrier disk, said ballast is made by surface mount procedure with small dimension components and surface mount components such that some of the small dimension components and surface mount components are mounted into the inner space of said lamp base.

6. The all-rounded illumination enveloped fluorescent lamp of claim 1, wherein the lamp and lamp tube each have an axial length, said axial length of the lamp tube is perpendicular to that of the lamp, and the lamp tube is fixed on the proximate end of said lamp carrier disk with metal clips and said ballast circuit board is fixed in parallel on the distal end of said lamp carrier disk; the ballast is made by surface mount procedure with small dimension components and surface mount components such that some of the small dimension components and surface mount components are mounted into the inner space of said lamp base.

7. An all-rounded illumination enveloped fluorescent lamp, comprising a lamp envelope made of light translucent materials, a lamp base, a lamp tube, having a tail, a circuit board, a lamp carrier disk having a distal end that faces the lamp base and a proximate end that faces the lamp tube, a ballast on the circuit board, a rear housing having a tail and a top end, wherein said lamp tube is fixed on the proximate end of said lamp carrier disk and said ballast on the circuit board is installed on the distal end of said lamp carrier disk; said ballast connects said lamp tube and said lamp base; said lamp envelope is connected to the top end of the rear housing; the lamp carrier disk and said circuit board are fixed and encapsulated in the space defined by the interior of the connected lamp envelope and rear housing such that said lamp envelope contains said lamp tube and said rear housing contains said ballast; and said lamp base is firmly installed on the tail of said rear housing and said lamp carrier disk and rear housing are made of light translucent materials and said circuit board is perpendicular to said lamp carrier disk.

8. The all-rounded illumination enveloped fluorescent lamp of claim 7, wherein said lamp carrier disk is made of transparent PC plastic, and said rear housing is made of transparent PC plastic with added colour powder.

9. The all-rounded illumination enveloped fluorescent lamp of claim 7, wherein said lamp and lamp tube each have an axial length, said axial length of said lamp tube superposes with that of the lamp and the tail of said lamp tube is conglutinated on the proximate end of said lamp carrier disk, said ballast being made by surface mount procedure with small dimension components and surface mount components and such that some of the small dimension components and surface mount components are mounted into the inner space of said lamp base.

10. The all-rounded illumination enveloped fluorescent lamp of claim 7, wherein said lamp and said lamp tube each have an axial length, said axial length of the lamp tube is perpendicular to that of the lamp, and the lamp tube is fixed on the proximate end of said lamp carrier disk with metal clips and said ballast circuit board is fixed in parallel on the distal end of said lamp carrier disk, the ballast being made by surface mount procedure with small dimension components and surface mount components such that some of the small dimension components and surface mount components are mounted into the inner space of said lamp base.

11. The all-rounded illumination enveloped fluorescent lamp of claim 2, wherein said lamp has an axial length and said circuit board has a thickness, said circuit board is parallel with said lamp carrier disk and the thickness of said circuit board along the axial length of the lamp is smaller than that of said lamp tube.

12. The all-rounded illumination enveloped fluorescent lamp of claim 2, wherein said lamp has an axial length, a segregation board with a thickness made with light translucent materials is installed in parallel between the circuit board and lamp carrier disk, and the thickness of said segregation board along the axial length of said lamp is smaller than that of said lamp tube.

13. The all-rounded illumination enveloped fluorescent lamp of claim 3, wherein said lamp has an axial length, a segregation board with a thickness made with light translucent materials is installed in parallel between the circuit board and lamp carrier disk, and the thickness of said segregation board along the axial length of said lamp is smaller than that of said lamp tube.

14. The all-rounded illumination enveloped fluorescent lamp of claim 2, wherein the lamp and lamp tube each have an axial length, the axial length of said lamp tube superposes with that of the lamp and the tail of said lamp tube is conglutinated on the proximate end of the lamp carrier disk, said ballast is made by surface mount procedure with small dimension components and surface mount components such that some of the small dimension components and surface mount components are mounted into the inner space of said lamp base.

15. The all-rounded illumination enveloped fluorescent lamp of claim 2, wherein the lamp and lamp tube each have an axial length, said axial length of the lamp tube is perpendicular to that of the lamp, and the lamp tube is fixed on the proximate end of said lamp carrier disk with metal clips and said ballast circuit board is fixed in parallel on the distal end of said lamp carrier disk; the ballast is made by surface mount procedure with small dimension components and surface mount components such that some of the small dimension components and surface mount components are mounted into the inner space of said lamp base.

16. The all-rounded illumination enveloped fluorescent lamp of claim 8, wherein the lamp and lamp tube each have an axial length, said axial length of said lamp tube superposes with that of the lamp and the tail of said lamp tube is conglutinated on the proximate end of said lamp carrier disk, said ballast being made by surface mount procedure with small dimension components and surface mount components and such that some of the small dimension components and surface mount components are mounted into the inner space of said lamp base.

17. The all-rounded illumination enveloped fluorescent lamp of claim 8, wherein the lamp and lamp tube each have an axial length, said axial length of the lamp tube is perpendicular to that of the lamp, and the lamp tube is fixed on the proximate end of said lamp carrier disk with metal clips and said ballast circuit board is fixed in parallel on the distal end of said lamp carrier disk, the ballast being made by surface mount procedure with small dimension components and surface mount components such that some of the small dimension components and surface mount components are mounted into the inner space of said lamp base.

* * * * *